United States Patent [19]

Smith et al.

[11] Patent Number: 4,712,524

[45] Date of Patent: Dec. 15, 1987

[54] FUEL INJECTION SYSTEM

[75] Inventors: Darren A. Smith, Scarsborough; Ian R. Thompson, Duncraig, both of Australia

[73] Assignee: Orbital Engine Company Proprietary Limited, Balcatta, Australia

[21] Appl. No.: 866,294

[22] Filed: May 23, 1986

[30] Foreign Application Priority Data

May 24, 1985 [AU] Australia ..... PH00730

[51] Int. Cl.[4] ..... F02M 67/00

[52] U.S. Cl. ..... 123/198 A; 123/575; 123/1 A; 123/531

[58] Field of Search ..... 123/575, 198 A, 1 A, 123/585, 587, 531, 533, 525

[56] References Cited

U.S. PATENT DOCUMENTS

| | | | |
|---|---|---|---|
| 4,170,205 | 10/1979 | Fiedler | 123/533 |
| 4,363,308 | 12/1982 | Emmenthal et al. | 123/533 |
| 4,519,356 | 5/1985 | Sarich | 123/531 |
| 4,554,945 | 11/1985 | McKay | 123/533 |
| 4,556,037 | 12/1985 | Wisdom | 123/533 |
| 4,570,598 | 2/1986 | Samson et al. | 123/585 |
| 4,628,888 | 12/1986 | Duvet | 123/531 |

*Primary Examiner*—E. Rollins Cross

*Attorney, Agent, or Firm*—Murray and Whisenhunt

[57] ABSTRACT

A method of delivering fuel to an internal combustion engine comprising delivering individual metered quantities of fuel into a conduit, and propelling each individual metered quantity of fuel along the conduit by an individual gas pulse. During the time interval between the respective gas pulses that deliver the metered quantities of fuel there is established a secondary gas flow in the conduit so as to limit variations in the quantity of fuel retained in the conduit as the metered quantity of fuel varies with engine fuel demand.

38 Claims, 6 Drawing Figures

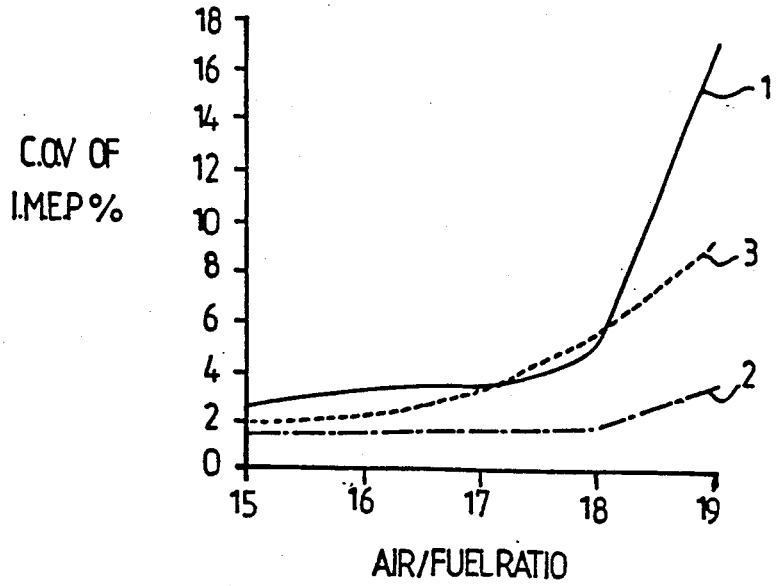
Fig.2
Fig.3
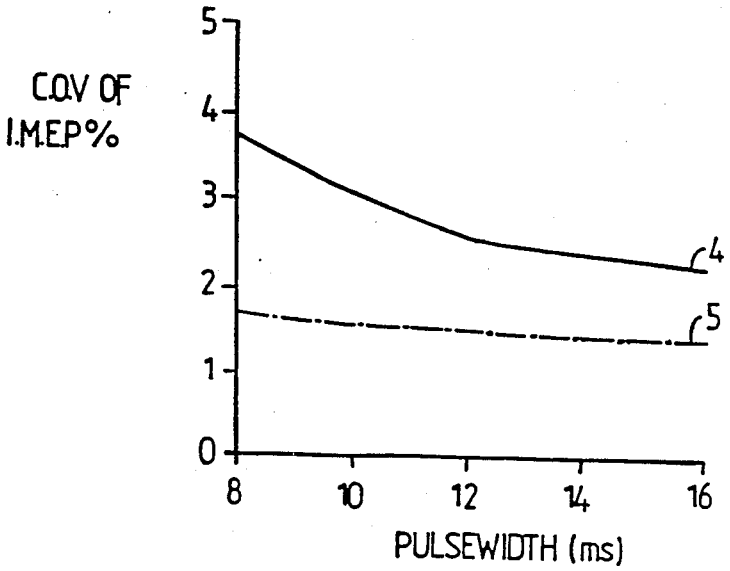

FUEL INJECTION SYSTEM

This invention relates to fuel injection systems for delivering metered quantities of fuel to an internal combustion engine, and is particularly applicable to systems wherein the fuel is introduced into the air induction system rather than directly into the engine combustion chamber.

Fuel metering systems are known where a prepared quantity of fuel is delivered to the engine by the application of air pressure to convey the individual quantity of fuel along a conduit and discharge it into the engine air induction system. Normally, the fuel is delivered to the induction system in the close vicinity of the combustion chamber inlet port. This form of fuel metering and injection system is disclosed in our U.S. Pat. Nos. 4,462,760 and 4,554,945 wherein the metered quantity of fuel is prepared in a chamber, and air under pressure is admitted to the chamber to displace the metered quantity of fuel therefrom. It is further proposed in our Australian patent application No. 92000/82 that the air admitted to the chamber be sufficient to convey the fuel along a delivery tube to the air induction system of the engine. In practice the quantity of air used to deliver each metered quantity of fuel does not vary substantially with the quantity of fuel being delivered, and is normally the same for each of the purality of metering units provided for a multi-cylinder engine.

Although this form of metering and injection of fuel to an engine induction system exhibits a low cycle to cycle variation in the fuel deliveries, when compared with other fuel injection systems, it has been found that cycle to cycle variations do exist and these variations can increase with an increase in the length of the fuel delivery tubes communicating the metering unit with the engine air induction system. These variations can be conveniently observed by measurement of the cycle to cycle variations in the indicated mean effective pressure (IMEP) in an engine cylinder.

It has been observed that increasing the volume of air used to propel the fuel through the delivery tube for each fuel delivery reduces the cycle to cycle variation in IMEP, reflecting that the cycle to cycle variation in fuel quantity is correspondingly reduced. The increase in the volume of air used per metered quantity of fuel may be achieved by lengthening the period over which the air pressure is applied to the metering chamber, or alternatively, by increasing the pressure of the air. Either of these alternatives would require additional control integers in the metering system, and would also lead to an increase in compressed air consumption, thus requiring a compressor of greater capacity, and place increased drive load on the engine.

It is believed that the cycle to cycle variation in fuel delivery is related to the amount of residual fuel which is retained in the form of a film on the wall of the fuel delivery tube extending between the metering device and the engine. It is believed that the average thickness of the fluid film increases as the metered quantity of fuel per delivery increases, when a fixed quantity of air is used to convey the fuel through the delivery tube. At low fuel quantities a greater portion of the fuel is suspended in the air propelling it through the delivery tube than at high fuel quantities, using a fixed quantity of air. Also it is believed that as the film thickness increases the variation in thickness from cycle to cycle increases as does the incidence of irregularities in film thicknes along the tube. Hence the cycle to cycle variation in the quantity of fuel actually delivered to the engine air induction system would increase with increase in quantity of fuel per delivery.

It is the principal object of the present invention to provide a method and apparatus for the delivery of metered quantities of fuel to an internal combustion engine wherein the above discussed problem is at least reduced so that there is a lowering of the cycle to cycle variation in fuel deliveries.

With this object in view there is provided according to the present invention a method of delivering fuel to an internal combustion engine including the steps of conveying individual metered quantities of fuel through a conduit to an engine by applying respective individual gas pulses to the conduit, and establishing in the conduit between the application of said pulses a gas flow to the engine.

More specifically there is provided a method of delivering fuel to an internal combustion engine comprising delivering individual metered quantities of fuel into a conduit, conveying each individual metered quantity of fuel along the conduit by an individual gas pulse, and establishing a secondary gas flow in the conduit for at least portion of the time interval between respective gas pulses that deliver the metered quantities of fuel along the conduit.

Conveniently, the conduit communicates with the air induction system of the engine to deliver the fuel thereto, preferably in the vicinity of the inlet port to the combustion chamber.

The secondary gas flow in the conduit, between the respective fuel deliveries, may be established by selectively communicating the conduit with atmospheric air so that the sub-atmospheric conditions in the air induction system will induce a flow of air through the conduit between each fuel delivery. Alternatively, the secondary gas flow may be provided from a suitable source, such as an air supply above atmospheric pressure and preferably lower than the pressure of the gas pulse that conveys the fuel through the conduit. The admission of the gas, for the secondary gas flow, to the conduit can be controlled by a one-way valve adapted to open when the pressure in the conduit is a selected amount below the pressure of the gas supply available to flow through the fuel conduit between fuel deliveries. Alternatively a controlled valve can be provided that is operated in timed relation to the passage of fuel through the conduit.

Preferably the secondary gas is introduced to the conduit in close vicinity to the location where the fuel is delivered thereto so that the flow of gas between the respective deliveries will travel the majority of the length of the fuel delivery conduit.

It has been found that the introduction of the secondary gas flow through the conduit achieves a substantial reduction in the cycle to cycle variation in the quantity of fuel delivered. It is believed that this result is achieved by the secondary gas flow reducing the tendency for the thickness of the fuel film on the internal surface of the conduit to increase, as the metered quantity of fuel increases, and so the fuel film remain substantially constant for all fuel quantities. As a result, changes in the quantity of fuel delivered to the engine are a true reflection of changes in the metered quantity of fuel prepared in the metering device.

There also is provided according to the invention apparatus for conducting individual metered quantities of fuel along a conduit to an engine which includes means to establish a gas flow through the conduit to the engine during at least part of the time interval between respective fuel deliveries through the conduit.

More specifically, there is provided apparatus for delivering fuel to an internal combustion engine including metering means to deliver individual metered quantities of fuel, conduit means to receive the fuel from the metering means and communicating with the engine, means to admit an individual gas pulse to the conduit at a location and a pressure to propel each metered quantity of fuel individually through the conduit to the engine, and means to establish a secondary gas flow in the conduit to the engine during at least part of the time interval between respective fuel deliveries.

Conveniently, the means of establishing the gas flow between the fuel deliveries includes means to selectively communicate the interior of the conduit with atmosphere, such as an openable valve means, so that the sub-atmospheric pressure in the engine induction system induces an air flow through the conduit. The means to establish said communication may be a pressure operable valve which closes in response to the application of the gas pressure pulse to propel the fuel through the conduit and, opens on the termination of that pulse when the sub-atmospheric pressure in the air induction system will induce a similar pressure within the conduit, and hence the external atmospheric pressure will open the valve to admit air to the conduit.

The means of metering the required quantity of fuel into the conduit may be in the form of the metering device shown in our prior U.S. Pat. No. 4,462,760, wherein the required metered quantity of fuel is held within a chamber, and is subsequently delivered therefrom by the opening of an appropriate valve, and the application of air at a suitable pressure to the chamber, to displace a metered quantity of fuel. The application of the air to the chamber can be continued for a period sufficient to transport the fuel into the conduit and along the length thereof, and to dispense the fuel into the engine induction system. Other known means of metering fuel and pneumatically conveying it into the induction system of the engine may also be used.

The use of the sub-atmospheric pressure in the engine induction system and fuel conduit as the means of opening the valve, to admit atmospheric air to the fuel conduit, may not be completely effective under wide open throttle conditions when the pressure in the induction system is substantially equal to atmospheric. This, however, is not a serious problem since the cycle to cycle variation experienced under wide open throttle conditions is lessened, due to the fact that the metered quantity of fuel during each delivery is relatively large and the variation in the thickness of the fluid film on the conduit tube will only be a relatively small proportion of the total quantity of metered fuel.

Also, it is possible to use, in combination with the present invention, a variation in the width of the gas pulse under wide open throttle conditions to reduce the potential increase of fluid film thickness on the internal surface of the fuel conduit. The concept of variation in the width of the driving air pulse in a pneumatic fuel injection system is discussed in greater detail in our Australian patent application No. 46892/85, the contents of which are incorporated herein by this reference.

It is of course to be understood that the air flow which is established in the fuel conduit, between the deliveries of the metered quantities of fuel, may be established from a pressurized air source rather than from ambient air. The necessary air could be obtained from the system which provides the air pulse to deliver the metered quantity of fuel, preferably with an appropriate reduction in the pressure of the air so as to reduce the mass of air required for the establishment of the flow between respective fuel delivery cycles.

In this regard it is to be appreciated that in our fuel metering system as described in U.S. Pat. No. 4,554,945 there is an amount of air normally exhausted from the air system at the conclusion of each fuel delivery, and that air could be applied to the fuel delivery conduit to provide the required low pressure flow between respective fuel deliveries. Such an arrangement would have the advantage that air, which is otherwise exhausted to atmosphere or required to be recirculated in the air system, can be discharged through the fuel metering conduit into the induction system. This would have the added advantage of reducing the quantity of exhaust air which must otherwise be handled within the air system, and having regard to the fact that the exhaust air may incorporate fuel vapour which must also be contained in order to meet pollution control requirements.

It will be appreciated that the flow of secondary air through the fuel conduit will at least initially result in the delivery of a further small quantity of fuel into the air induction system of the engine. It is desirable that this additional fuel be used in the same engine cycle as the immediately preceding metered quantity of fuel. Accordingly, the timing of the delivery of the metered quantity of fuel, and of the establishment of the secondary air flow in the fuel conduit, should be such that both occur before or during the period that the air inlet valve to the engine cylinder is open. Preferably, the injection of the metered quantity of fuel is initiated as the inlet valve commences to open, and thus the full duration of the inlet valve open period is available for the fuel conveyed by the gas pulse and the majority of the subsequently purged fuel from the fuel line to enter the cylinder for combustion during that particular engine cycle. Under some operating conditions it is possible that some of the fuel purged from the fuel line may not enter the cylinder until the next cycle.

Another advantage which flows from the present invention is the possibility to establish substantially atmospheric pressure in the upstream end of the fuel delivery conduit at the instant of commencement of the delivery of the metered quantity of fuel into the fuel conduit. In previously proposed arrangements the sub-atmospheric pressure in the manifold normally exists at the upstream end of the fuel delivery conduit where a delivery valve is normally provided between the chamber in which the metered quantity of fuel is prepared and the fuel conduit. The delivery valve must be biased towards the closed position with sufficient force to counteract the effects of the fuel pressure in the chamber tending to open the valve, and the sub-atmospheric pressure in the fuel conduit also tending to open the valve. By establishing atmospheric or near atmospheric pressure at the upstream end of the fuel conduit between respective fuel deliveries the total pressure drop across the delivery valve is reduced, and so the spring or other device holding the valve in the closed position may be reduced in strength and hence the crack pressure of the valve correspondingly reduced.

The lowering of the pressure drop across the delivery valve between the metering chamber and the fuel delivery conduit contributes in a number of additional ways to the improved operating efficiency of the fuel injection system. Firstly, it results in a lower residual gas pressure in the metering chamber and associated gas passageways in the metering device at the end of each injection of fuel. This in turn results in a reduction of the mass of gas to be released and displaced by the incoming fuel for the next cycle, and a consequent reduction in the load applied on the vapor handling system which must be associated with the fuel metering device to avoid pollution. Secondly, it will permit a reduction in the operating pressure and capacity of the compressor used to provide the compressed gas to the metering device. Thirdly, the reduction in the force required to open the delivery valve results in the valve remaining open for a longer period, which is particularly significant when operating under high fuel loads such as at wide open throttle conditions.

The invention will be more readily understood from the following description of one practical arrangement of the fuel injection system illustrated in the accompanying drawings.

In the drawings

FIGS. 2 and 3 are graphic representations of the performance of the injection system of the present invention in comparison with other injection systems;

Figure 1:
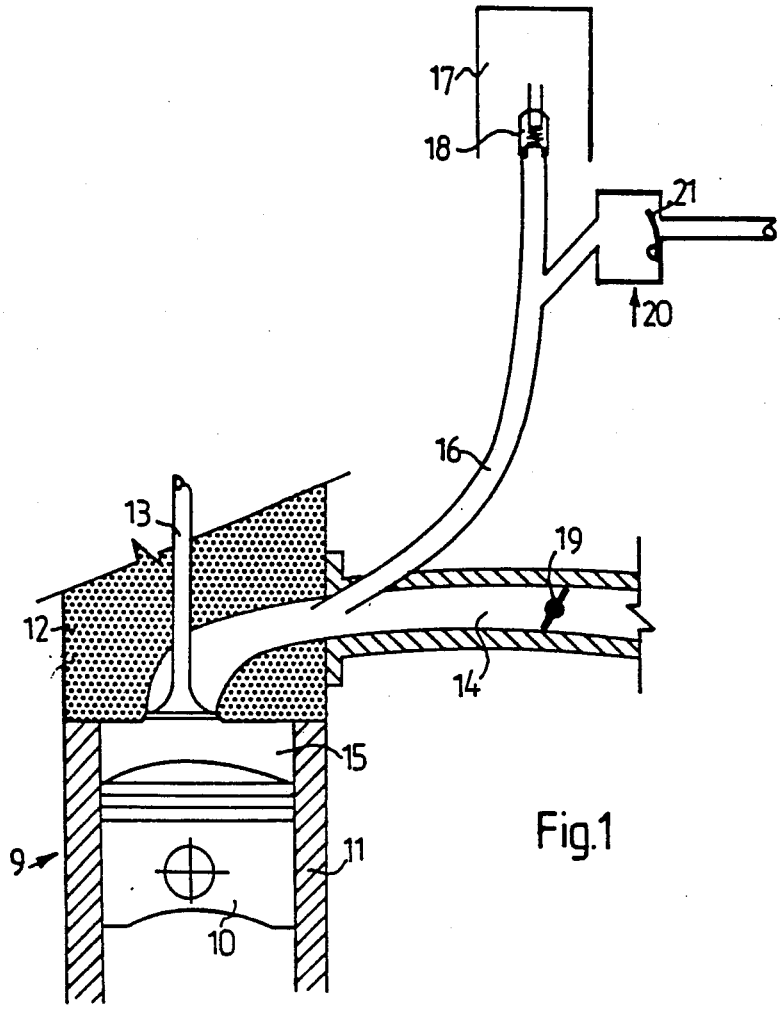
FIG. 1 is a diagrammatic representation of the injection system supplied to a single cylinder engine.

Referring now to FIG. 1, the engine is indicated diagramatically at 9 as a reciprocating engine having a piston 10 operating in a cylinder 11 and having a cylinder head 12 incorporating an inlet valve 13 controlling communication between the air induction passage 14 and the combustion chamber 15 within the cylinder 11. A throttle valve 19 is provided in the induction passage 14.

The fuel delivery conduit 16 communicates with the air induction passage 14 at one end and with the fuel metering unit 17 at the other end. The detailed construction of the metering unit will be described further hereinafter, however, the unit is of the type wherein a metered quantity of fuel is prepared and delivered from the metering unit 17 into the fuel delivery conduit 16 upon the opening of the valve 18 therebetween. The application of air under pressure to the fuel in the metering device opens the valve 18 to deliver the fuel through the valve and along the conduit 16 to the air induction passage 14. The air under pressure is applied to the fuel for a preset period of time which is sufficient to effect the transfer of substantially all the metered quantity of fuel from the metering unit to the air induction passage. Upon relief of the air pressure the valve 18 closes and the metering of the next quantity of fuel is commenced.

Under previously proposed conditions, the subatmospheric pressure existing in the induction passage 14 down stream of the throttle valve 19 would also exist throughout the length of the conduit 16 for the period of time between successive deliveries of fuel. However, the present invention contemplates the provision of a vent unit 20 communicating with the interior of the conduit 16 adjacent the end of conduit connected to the metering unit 17. The vent unit 20 incorporates a pressure actuated vent valve 21 such as a reed valve with one side of the vent valve subjected to the pressure conditions existing in the fuel delivery conduit 16 and the other side of the valve being subjected to ambient conditions, or at least to the conditions existing in the downstream side of an air filter (not shown) provided for the air induction passage 14 of the engine.

Accordingly, when the pressure conditions in the fuel delivery conduit 16 are below those of the filtered air, the vent valve 21 will open to permit filtered air to be fed into the conduit 16 and hence pass along the conduit to be delivered into the air induction passage 14. When the pressure conditons in the upstream end of conduit 16 are above those at the air filter, such as when the air under pressure is effecting delivery of a metered quantity of fuel through the fuel delivery conduit 16, the vent valve will close to interrupt communication between the air filter and the conduit 16.

It will thus be seen that during the period that fuel is being delivered to the engine through the fuel delivery conduit 16, the vent valve 21 is closed to prevent the introduction of ambient air into the conduit, and prevent the escape of air and/or fuel from the fuel conduit 16 through the vent unit 20.

As previously discussed, in fuel injection systems wherein individual metered quantities of fuel are propelled by a pulse of compressed air into the engine induction system, a film of fuel is left on the walls of the conduit through which the fuel passes, and the thickness of this film can vary with engine operating conditions and consequently vary the final amount of fuel. The previously described cycle to cycle variation in fuel delivery involves variations in the amount of fuel delivered to a particular cylinder from one cycle to the next, and such variation naturally affects the smooth performance of the engine. To counteract this problem it has previously been customary to arrange for the metered quantity of fuel to be somewhat in excess of the actual fuel demand. Naturally, this technique leads to fuel inefficiency and also emission problems particularly in regard to unburned hydrocarbons.

The provision of the vent unit 20 to provide a secondary air flow through the fuel delivery conduit, after the termination of the principal air pulse provided to deliver the metered quantity of fuel to the air induction passage 14, results in this additional air flow removing the majority if not all of the fuel film on the internal walls of the fuel delivery conduit, so that for each fuel delivery substantially the total metered quantity is delivered into the air induction passage for admission to the engine chamber. Accordingly, it is possible for the metered quantity of fuel to be set at the actual fuel requirement of the engine, and to ensure that that metered quantity is all delivered to the engine induction system. This avoids enrichment of the mixture, with resulting fuel saving and the maintainence of correct combustion conditions.

FIG. 2 is a graphic representation of co-efficient of variation of indicated mean effective pressure (C O V of IMEP) in the combustion chamber 15 of the engine plotted against the air/fuel ratio of the mixture provided to the combustion chamber in a four cycle 1.6 liter four cylinder engine running at a fixed speed of 1500 rpm and a fixed spark advance, the major variable being the different fuel injection systems. The C O V of IMEP is a convenient way of determining cycle to cycle variations in the amount of fuel actually being delivered to the combustion chamber, since the IMEP is directly related to the amount of fuel burnt in the combustion chamber during any one cycle.

The plot 1 shows the C O V of IMEP against air/fuel ratio using a pneumatic fuel injection system of the applicant's own design and which is based on the construction hereinafter described in respect of FIGS. 6 and 7.

Plot 2 is taken using the identical fuel injection system with the addition of the air vent unit as previously described in respect of FIG. 1 of the drawings.

It will be noted that in respect of plot 1, as the air/fuel ratio increases above about 17.5, that is as the mixture becomes leaner, the C O V of IMEP increases extremely rapidly. However it is seen from plot 2 that with the engine operating under the same conditions but with the addition of the air vent unit an increase in C O V of IMEP at air/fuel ratios above 18 is present but is substantially reduced compared with that of plot 1.

Plot 3 in FIG. 2 shows the results obtained with the same engine operating at the same speed but using a commercially available fuel injection system wherein metering is achieved by selective opening of a nozzle at the point of delivery into the engine air induction system. The fuel line leading to that valve thus remains filled with fuel during all operating times. It will be noted that the system in accordance with the present invention shows significant improvements in cycle to cycle variation over that obtained with such a system.

FIG. 3 is a graphic representation of the C O V of IMEP plotted against variations in the period of application of the air pulse to the metered quantity of fuel to propel it through the fuel delivery conduit to the air induction passage. These plots were obtained running the same engine as was used in respect of the information in FIG. 2 and operated at the same speed of 1500 rpm. The plots 1 and 2 shown in FIG. 2 were obtained with a fixed pulse width of 12 milliseconds and the plots shown in FIG. 3 were obtained over a range of pulse widths from 8 to 16 milliseconds. It will be noted from plot 4, obtained using the non-air vented fuel injection system, that there is a significant increase in C O V of IMEP as the pulse width decreases, and there is a sharp increase in the C O V below a pulse width of about 12 milliseconds. By comparison it can be seen from plot 5 that when the fuel delivery conduit is air vented in accordance with the present invention there is little change in the C O V of IMEP over the full range of pulse widths from 8 to 16 milliseconds.

These two plots as shown in FIG. 3 clearly establish that a comparatively small pulse width of high pressure air can be used without any sacrifice in cycle to cycle variation in fuel delivery. Substantial saving can thus be made, by the use of the present invention, in the amount of compressed air required to operate the fuel injection system, with consequent saving in costs of manufacture and operation of the compressor system.

FIG. 2 also indicates that the engine can be operated reliably at high air/fuel ratios, that is lean mixtures, with very stable engine operation which leads to improved drivability and reduced exhaust emissions, particularly hydrocarbons of the vehicle fitted with such engines.

Figure 4:
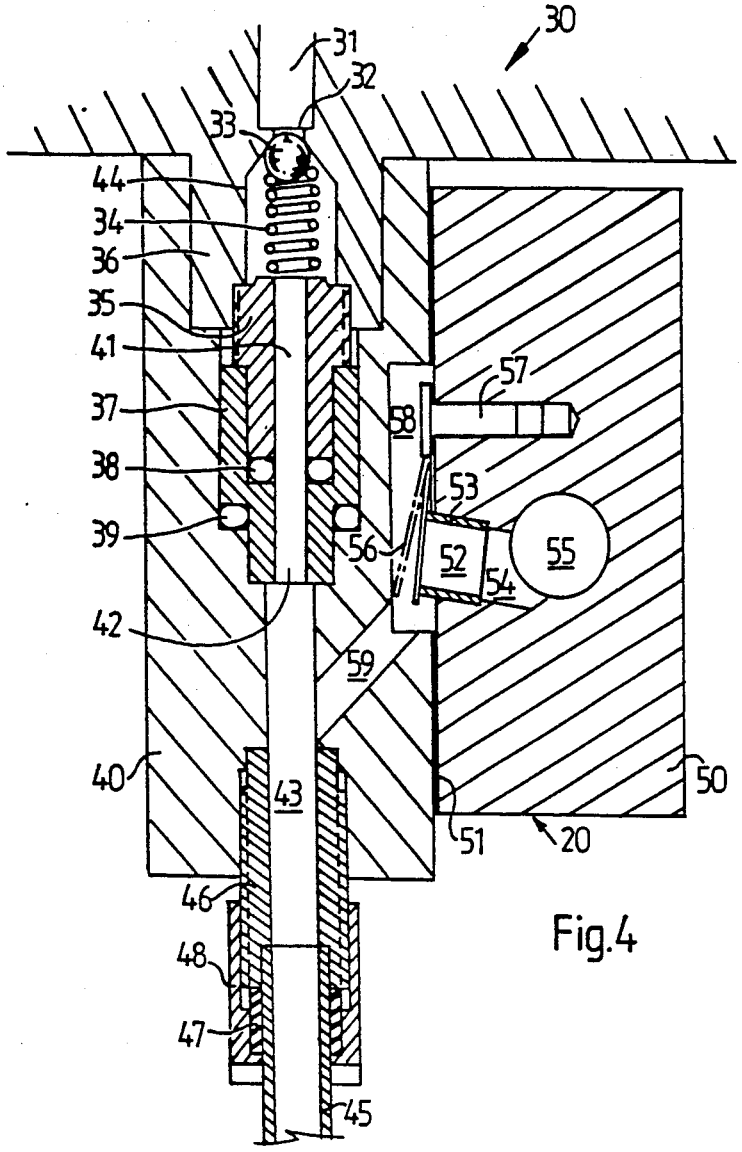
FIG. 4 is a sectional view of one embodiment of the vent unit shown in FIG. 1.

FIG. 4 of the drawings shows one actual embodiment of the vent unit 20 as illustrated diagrammatically in FIG. 1 assembled to a metering unit 17. A practical arrangement of the preferred form of metering unit will be described hereinafter in reference to FIGS. 5 and 6 but there is shown in FIG. 4 portion of the body 30 of such a metering unit having a metering chamber 31 with a delivery port 32 at the lower end thereof. The valve element 33 is biased by the spring 34 to a position closing the port 32. The bush 35 is threadably received in the extension 36 of the body 30. The sleeve 37 and the O rings 38 and 39 co-operate with the portion 40 of the body of the vent unit 20 to provide a fluid tight seal between the vent body portion 40 and the metering body portion 30. The vent body portion 40 is secured to the metering body portion 30 by appropriate bolts or studs (not shown in FIG. 4) so as to maintain the O ring seals 38 and 39 in compression.

The bush 35, sleeve 37 and vent body portion 40 are provided with coaxial fuel passages 41, 42 and 43 to provide a fuel flow path from the chamber housing the spring 34 to the fuel delivery tube 45. The coupling tube 46 is threadably received in the end of the passage 43 and the fuel tube 45 is received therein and secured thereto by the gland packing 47 and the gland nut 48.

The vent body portion 40 is secured to the portion 50 by appropriately located bolts or studs (not shown in FIG. 4.) with a sealing gasket 51 between the body portions 40 and 50. The air port 52 is formed by the bush 53 inserted in the passage 54 which communicates with the air passage 55. The reed type valve element 56 is anchored by the stud 57, the valve element 56 being of a resilient material and shaped so as to normally seal against the end of the bush 53 so as to close the air port 52. When a sufficient pressure difference exists across the vent valve it will be resiliently deflected to occupy the position shown in dotted outline in FIG. 4 thereby opening the air port 52. When the valve element 56 is in the open position communication will be provided between the air passage 55 and the chamber 58 formed in the vent body portion 40. The chamber 58 in turn communicates with the fuel passage 43 via the air passage 59.

It will be appreciated that the metering unit for a multi-cylinder engine normally incorporates a number of individual metering chambers each arranged to supply fuel to the induction manifold for a particular cylinder. Accordingly the vent unit as above described with reference to FIG. 4 can be made so as to be fitted to a multi-chamber metering unit and to provide air thereto through respective air ports 52 feeding from a common air passage 55. The air passage would receive air through a suitable filter which may be the air filter incorporated in the main air supply to the engine.

Figure 5:
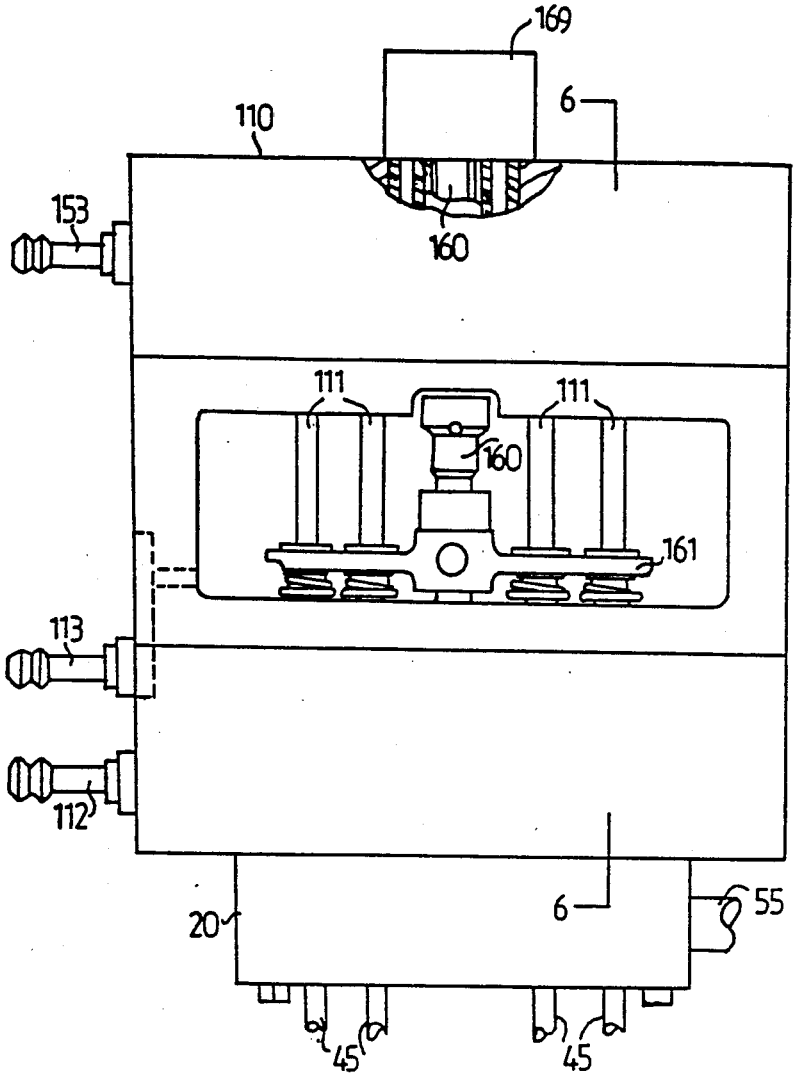
FIG. 5 is a front view of one form of multi-cylinder fuel metering device with a vent unit fitted thereto.

The fuel metering unit 17 may be of any construction that produces an individual metered quantity of fuel for each fuel delivery, and that individual quantity of fuel is delivered to a fuel conduit. It may include provision that the individual quantity of fuel is delivered from the metering unit 17 by an individual charge of gas which then continues to conduct the individual quantity of fuel along the conduit 16 to the engine, or it may simply deliver the fuel into the conduit and allow an individual charge of gas from another source to propel the fuel to the engine. One suitable metering unit is illustrated in FIGS. 5 and 6 and will now be described with reference to those illustrations.

The metering apparatus shown comprises a body 110, having incorporated therein four individual metering units 111 arranged in side by side parallel relationship. This apparatus is thus suitable for use with a four cylinder engine, with each metering unit 111 dedicated to a separate cylinder. The nipples 112 and 113 are adapted for connection to a fuel supply line and a fuel return line respectively, and communicate with respective fuel supply and return galleries 60 and 70 provided within the body 110 for the supply and return of fuel from each of the metering units 111. Each metering unit 111 is provided with a bush 114 for engagement with a corresponding vent unit (as bush 35 is engaged with the vent unit 20 in FIG. 4), by way of which the individually metered quantities of fuel are conducted to the inlet manifold of the engine near the respective cylinder inlet valve.

The body 110 is preferably positioned close to and generally central of the inlet manifold of the engine and the fuel conduits are suitable tubing. In a four cylinder 1.5 liter engine the tubing is approximately 1.7 mm internal diameter, and from 10 to 40 cm in length varying with the distance to each cylinder. Some conduits would be longer on a 3 liter in-line six cylinder engine.

Figure 6:
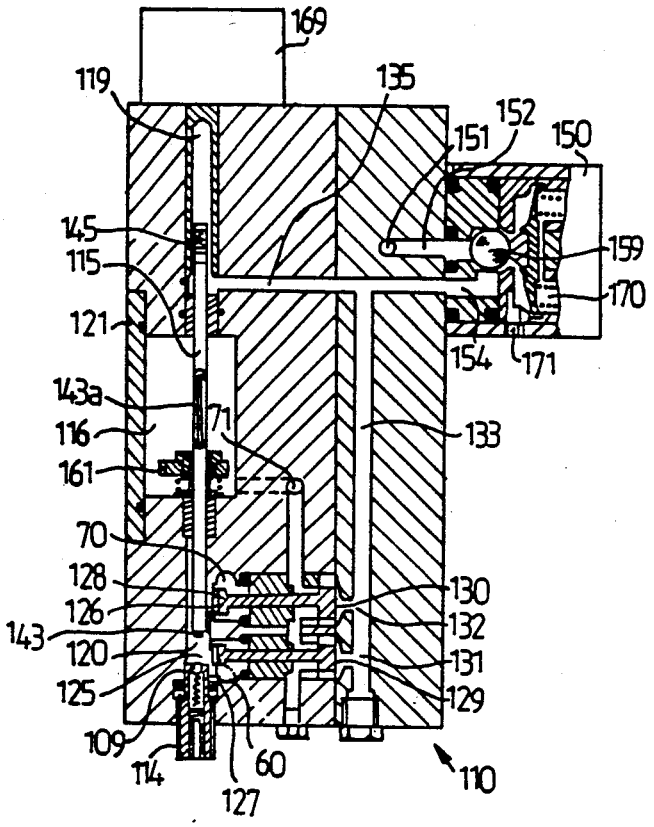
FIG. 6 is a sectional view along line 6—6 in FIG. 5 of the fuel metering device with the vent unit removed.

FIG. 6 shows in section one metering unit having a metering rod 115 extending into the air supply chamber 119 and metering chamber 120. Each of the four metering rods 115 pass through the common leakage collection chamber 116 formed by a cavity provided in the body 110 and the coverplate 121 attached in sealed relation to the body 110. The function and operation of the leakage collection chamber is not part of this invention and is described in greater detail in our U.S. Pat. No. 4,554,945.

Each metering rod 115 is hollow, and is axially slidable in the body 110, and the extent of projection of the metering rod into the metering chamber 120 may be varied to adjust the quantity of fuel displaceable from the metering chamber. The valve 143 at that end of the metering rod located in the metering chamber 120, is supported by the rod 143*a*, and is normally held closed by the spring 145 located between the upper end of the metering rod 115 and valve rod 143*a*, to prevent the flow of air through the hollow bore of the metering rod 115 from the air supply chamber 119 to the metering chamber 120. Upon the pressure in the chamber 119 rising to a predetermined value the valve 143 is opened so air will flow from chamber 119 to the metering chamber through metering rod 115, and thus displace the fuel from the metering chamber 120. The quantity of fuel displaced by the air is that fuel located in the chamber 120 between the point of entry of the air to the chamber, and the point of discharge of the fuel from the chamber, that is, the quantity of fuel between the air admission valve 143 and the delivery valve 109 at the opposite end of the metering chamber 120.

Each of the metering rods 115 are coupled to the crosshead 161, and the crosshead is coupled to the actuator rod 160, which is slidably supported in the body 110. The actuator rod 160 is coupled to the motor 169, which is controlled in response to the engine fuel demand, to adjust the extent of projection of the metering rods 115 into the metering chambers 120, and hence the position of the air admission valves 143, so the metered quantity of fuel delivered by the admission of the air is in accordance with the fuel demand. The motor 169 may be a reversible type linear stepper motor.

The fuel delivery valves 109 are each pressure actuated to open in response to the pressure in the metering chamber 120, when the air is admitted thereto from the air supply chamber 119. Upon the air entering the metering chamber 120 through the valve 143 the delivery valve 109 also opens and the air will move towards the delivery valve displacing fuel from the metering chamber through the delivery valve. The air admission valve 143 is maintained open until sufficient air has been supplied to displace the fuel between the valves 143 and 109 from the chamber, and to convey the fuel through a fuel conduit to the engine inlet manifold.

Each metering chamber 120 has a respective fuel inlet port 125 and a fuel outlet port 126 controlled by respective valves 127 and 128 to permit circulation of fuel from the inlet gallery 60 through the chamber 120 to the outlet gallery 70. Each of the valves 127 and 128 are connected to the respective diaphragms 129 and 130. The valves 127 and 128 are spring-loaded to an open position, and are closed in response to the application of air under pressure to the respective diaphragms 129 and 130 via the diaphragm cavities 131 and 132. Each of the diaphragm cavities are in constant communication with the air conduit 133, and the conduit 133 is also in constant communication with the air supply chamber 119 by the conduit 135.

Thus, when air under pressure is admitted to the air supply chamber 119 and hence to the metering chamber 120 to effect delivery of fuel, the air also acts on the diaphragms 129 and 130 to cause the valves 127 and 128 to close the fuel inlet and outlet ports 125 and 126.

The control of the supply of air to the chamber 119 through conduit 135, and to the diaphragm cavities 131 and 132 through conduit 133, is regulated in time relation with the cycling of the engine through the solenoid operated valve 150. The common air supply conduit 151 connected to a compressed air supply via nipple 153, runs through the body 110 with respective branches 152 providing air to the solenoid valve 150 of each metering unit 111.

Normally the spherical valve element 159 is positioned, under the action of spring 170, to prevent the flow of air from conduit 151 to conduit 135 and to vent conduit 135 to atmosphere via port 171. When the solenoid is energised the force of the spring 170 acting on the valve element 159 is overcome, and the valve element is displaced by the pressure of the air supply to permit air to flow from conduit 151 to conduits 135 and 133.

When the solenoid is de-energised the spring 170 returns the valve element 159 to the position to terminate the air flow from conduit 151 to conduit 135 and so completes the delivery of the fuel from the metering chamber 120. This movement of the valve element also vents the air in the conduits 133 and 135 the chamber 119, and diaphragm cavities 131 and 132 to atmosphere through the port 171. As referred to hereinbefore this vented air could be used as at least part of the secondary air flow in the vent unit rather than be exhausted to atmosphere. In such a construction a conduit would connect the port 171 and the air passage 55 of the vent unit 20.

The timing of the energizing of the solenoid 150 in relation to the engine cycle may be controlled by a suitable sensing device activated by a rotating component of the engine such as the crankshaft or flywheel or any other component driven at a speed directly related to engine speed. A sensor suitable for this purpose is an optical switch including an infra-red source and a photo detector with Schmitt trigger.

The most straight forward strategy for controlling the amount of air used to expel the metered quantity of fuel from the metering chamber 120 is to programme an electronic controller, to actuate solenoid 150, for the same time internal for each air pulse, independent of the engine fueling requirements. In other words, the controller signals a constant pulse width to the solenoid. The strategy of using a fixed air pulse duration is rendered more acceptable when used in combination with the venting of the fuel delivery conduits between fuel delivery cycles. This venting eliminates or reduces significantly variations in quantity of fuel actually delivered to the engine, where otherwise it would be desirable to vary the air pulse duration to achieve a similar result.

There has recently been developed a modified construction of the metering unit described with reference to FIGS. 5 and 6 and that construction may be used as an alternative to that shown in FIGS. 5 and 6. The modified construction is disclosed in detail in the U.S. patent application lodged the same date as this application and entitled 'Improvements Relating to Apparatus for Delivering Fuel to Internal Combustion Engines', and claiming Convention Priorty from Australian patent application No. PH00731 lodged May 24th 1985, the disclosure of which is hereby incorporated by reference.

The method and apparatus as described herein for delivering liquid fuel to an internal combustion engine may be used in any form of engine including both two stroke cycle and four strike cycle engines, and such engines may be for or incorporated in vehicles for use on land, sea or in the air, including engines in or for motor vehicles, boats or aeroplanes. The method and apparatus may be used with engines wherein the fuel is delivered directly into the combustion chamber, or into the air induction system of the engine, and the fuel may be spark ignited or compression ignited.

In particular the method and apparatus may be used with engines as herein described where the engines are installed in a boat, vehicle or aeroplane to propel same, and include outboard marine engines.

We claim:

1. A method of periodically delivering units of liquid fuel to an internal combustion engine having a fuel metering device for providing individual metered quantities of fuel for supply to the engine, and a conduit communicating the fuel metering device to the engine, said method comprising applying an individual gas pulse to each respective metered quantity of fuel to convey the fuel from the fuel metering device through the conduit to the engine, and establishing a secondary gas flow through at least part of the conduit to the engine at least part of the time between successive gas pulse applications to reduce cycle to cycle variations in fuel deliveries.

2. A method of delivering liquid fuel to an internal combustion engine including the steps of preparing an individual metered quantity of fuel, delivering each metered quantity of fuel individually into a conduit, applying an individual pulse of gas to each metered quantity of fuel to convey same through the conduit and deliver that fuel to the engine, and establishing a secondary gas flow in the conduit to the engine after the application of said gas pulse and before the delivery of the next metered quantity of fuel to the conduit.

3. A method of delivering liquid fuel to an internal combustion engine comprising delivering individual metered quantities of fuel into a conduit, conveying each individual metered quantity of fuel along the conduit by an individual gas pulse during a time interval, and establishing a secondary gas flow in the conduit for at least portion of the time interval between respective gas pulses that convey the metered quantities of fuel along the conduit.

4. A method as claimed in claim 1, 2 or 3 wherein said secondary gas flow is initiated in the conduit adjacent the position of entry of the fuel into the conduit.

5. A method as claimed in claim 1, 2 or 3 wherein the secondary gas flow travels substantially the complete length of the conduit.

6. A method as claimed in any one of claims 1, 2 or 3 where the secondary gas flow is established from an air source at substantially atmospheric pressure.

7. A method as claimed in any one of claims 1, 2 or 3 wherein the fuel is conveyed through the conduit to an air induction system of the engine.

8. A method as claimed in any one of claims 1, 2 or 3 wherein the secondary gas flow in the conduit is initiated when a predetermined pressure exists in the conduit said predetermined pressure being below the pressure established therein by the gas pulse.

9. A method as claimed in claim 8 wherein said predetermined pressure is substantially atmospheric pressure.

10. A method of delivering liquid fuel to an internal combustion engine comprising collecting an individual metered quantity of fuel in a chamber, selectively communicating said chamber with a fuel conduit through which fuel can be delivered to the engine, applying a gas pulse to the fuel in the chamber when the chamber is in communication with said conduit to discharge the metered quantity of fuel from the chamber and convey it through the fuel conduit to the engine, and establishing a secondary gas flow through the fuel conduit to the engine for at least portion of the time interval between respective gas pulses that convey the metered quantities of fuel to the engine.

11. A method as claimed in claim 10 wherein the fuel conduit communicates the chamber with an air induction system of the engine.

12. A method as claimed in claim 10 or 11 wherein the secondary gas flow is established from an air source at substantially atomospheric pressure.

13. A method as claimed in claim 10 or 11 wherein the gas pulse to discharge the fuel from the chamber and convey it to the engine is established by cyclic operation of a valve controlling the delivery of air at above atomospheric pressure to the chamber, and venting air downstream of said valve during the time interval between respective gas pulse to provide at least part of the air required for admission to the fuel conduit to establish said secondary flow.

14. A method as claimed in any one of claims 1, 2, 3, or 10 wherein the gas flow is established for substantially the whole of the interval between respective gas pulses.

15. An fuel injection apparatus for injecting fuel into an engine comprising a conduit and metering means for forming individual metered quantities of liquid fuel and for periodically conducting said metered quantities at time intervals along said conduit to said engine, the improvement comprising means for establishing a secondary gas flow through at least part of the conduit to the engine during at least part of the time interval between respective fuel deliveries through the conduit to reduce cycle to cycle variations in fuel deliveries.

16. Apparatus for delivering liquid fuel to an internal combustion engine comprising metering means for forming individual metered quantities of fuel, conduit means for delivering the fuel quantities from the metering means to the engine, gas admission means for periodically admitting an individual gas pulse to said conduit means at a location to convey each respective metered quantity of fuel individually through the conduit means to the engine during a time interval, and means to establish a secondary gas flow through at least part of the conduit means to the engine during at least part of the time interval between respective fuel deliveries to reduce cycle to cycle variations in fuel deliveries.

17. Apparatus as claimed in claim 15 or 16 wherein the means to establish the secondary gas flow in the conduit is responsive to the predetermined pressure in the conduit means being below the pressure established therein by the gas pulse.

18. Apparatus as claimed in claim 15 or 16 wherein the means to establish the secondary gas flow in the conduit means includes valve means adapted to communicate the conduit means with atmospheric air in response to a predetermined pressure below atmospheric pressure existing in the conduit means.

19. Apparatus for delivering liquid to an internal combustion engine including metering means to cyclically collect in a chamber individual metered quantities of fuel, conduit means to receive the individual metered quantities of fuel from the chamber for conveyence to an engine, means to cyclically admit an individual gas pulse to the chamber to displace each individual metered quantity of fuel from said chamber into the conduit means and convey the fuel therethrough to the engine during a time interval, and means to establish a secondary gas flow in the conduit means to the engine during at least part of the time interval between the gas admission cycles to the conduit means.

20. Apparatus as claimed in claim 19 wherein the means cyclically admit the gas pulse includes valve means operable to cyclically communicate the chamber with an above atmospheric pressure air supply to establish said gas pulse and between cycles vent gas downstream of the valve means to the conduit means to establish or during said secondary air flow.

21. In a vehicle propelled by an internal combustion engine, said vehicle including a vehicle body, wheels supporting said body for travel on the ground and a liquid fuel injected internal combustion engine mounted in the body to propel the vehicle said engine being adapted to have liquid fuel delivered thereto by a method including the steps of preparing an individual metered quantity of fuel, delivering each metered quantity of fuel individually into a conduit, applying an individual pulse of gas to each metered quantity of fuel to convey same through the conduit and deliver that fuel to the engine, and establishing a secondary gas flow in the conduit to the engine after the application of said gas pulse and before the delivery of the next metered quantity of fuel to the conduit.

22. In a vehicle propelled by an internal combustion engine, said vehicle including a vehicle body, wheels supporting said body for travel on the ground and a liquid fuel injected internal combustion engine mounted in the body to propel the vehicle said engine having apparatus for delivering liquid fuel thereto, said apparatus including metering means to deliver individual metered quantities of fuel, conduit means to receive the fuel delivered from the metering means and communicating with an engine, means to admit an individual gas pulse to the conduit means at a location to convey each metered quantity of fuel individually through the conduit means to the engine, and means to establish a secondary gas flow in the conduit means to the engine during at least part of the time internal between respective fuel deliveries.

23. In a vehicle as claimed in claim 21 or 22 wherein the liquid fuel is injected into the air induction system of the engine.

24. An internal combustion engine for propelling a vehicle said engine being a fuel injected engine having apparatus for delivering liquid fuel thereto, said apparatus including metering means to deliver individual metered quantities of fuel, conduit means to receive the fuel delivered from the metering means and communicating with an engine, means to admit an individual gas pulse to the conduit means at a location to convey each metered quantity of fuel individually through the conduit means to the engine, and means to establish a secondary gas flow in the conduit means to the engine during at least part of the time internal between respective fuel deliveries.

25. In a boat to be propelled by an internal combustion engine including a boat hull and a fuel injected internal combustion engine filled to said hull to propel same said engine being adapted to have liquid fuel delivered thereto by a method including the steps of preparing an individual metered quantity of fuel, delivering each metered quantity of fuel individually into a conduit, applying an individual pulse of gas to each metered quantity of fuel to convey same through the conduit and deliver that fuel to the engine, and establishing a secondary gas flow in the conduit to the engine after the application of said gas pulse and before the delivery of the next metered quantity of fuel to the conduit.

26. In a boat to be propelled by an internal combustion engine including a boat hull and a fuel injected internal combustion engine filled to said hull to propel same said engine having apparatus for delivering liquid fuel thereto, said apparatus comprising metering means to deliver individual metered quantities of fuel, conduit means to receive fuel delivered from the metering means and communicating with an engine, means to admit an individual gas pulse to the conduit means at a location to convey each metered quantity of fuel individually through the conduit means to the engine during a time interval, and means to establish a secondary gas flow in the conduit means to the engine during at least part of the time internal between respective fuel deliveries.

27. In a boat as claimed in claim 25 or 26 wherein the liquid fuel is injected into the air induction system of the engine.

28. In a boat as claimed in any one of claims 25 or 26 wherein the engine in an outboard marine engine.

29. An internal combustion engine for propelling a boat, said engine being a fuel injected engine having apparatus for delivering liquid fuel thereto, said apparatus including metering means to deliver individual metered quantities of fuel, conduit means to receive the fuel delivered from the metering means and communicating with an engine, means to admit an individual gas pulse to the conduit means at a location to convey each metered quantity of fuel individually through the conduit means to the engine during a time interval, and means to establish a secondary gas flow in the conduit means to the engine during at least part of the time internal between respective fuel deliveries.

30. An internal combustion engine as claimed in claim 29 wherein the engine is outboard marine engine.

31. The method of delivering liquid fuel to an internal combustion engine as claimed in any one of claims 1, 2, 3 or 10 wherein said engine is used to propel vehicle.

32. The method of delivering liquid fuel to an internal combustion engine as claimed in any one of claims 1, 2, 3 or 10 wherein said engine is used to propel an aeroplane.

33. The method of liquid delivering fuel to an internal combustion engine as claimed in any one of claims 1, 2, 3 or 10 wherein said engine is used to propel a boat.

34. The method as claimed in claim 33 wherein the engine is an outboard marine engine.

35. Apparatus for delivering liquid fuel to an internal combustion engine as claimed in any one of claims 15, 16, or 19 wherein said engine is used to propel a vehicle.

36. Apparatus for delivering liquid fuel to an internal combustion engine as claimed in any one of claims 15, 16 or 19 wherein said engine is used to propel an aeroplane.

37. Apparatus for delivering liquid fuel to an internal combustion engine as claimed in any one of claims 15, 16 or 19 wherein said engine is used to propel a boat.

38. Apparatus for delivering liquid fuel to an internal combustion engine as claimed in claim 37 wherein said engine is an outboard marine engine.

* * * * *